US009283781B2

(12) United States Patent
Hosono

(10) Patent No.: US 9,283,781 B2
(45) Date of Patent: Mar. 15, 2016

(54) CUTTING APPARATUS

(75) Inventor: Shinichiro Hosono, Tokyo (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 684 days.

(21) Appl. No.: 12/936,943

(22) PCT Filed: Dec. 2, 2008

(86) PCT No.: PCT/JP2008/071853
§ 371 (c)(1),
(2), (4) Date: Nov. 3, 2010

(87) PCT Pub. No.: WO2009/157103
PCT Pub. Date: Dec. 30, 2009

(65) Prior Publication Data

US 2011/0079130 A1 Apr. 7, 2011

(30) Foreign Application Priority Data

Jun. 26, 2008 (JP) ..... 2008-167798

(51) Int. Cl.
*B41J 11/70* (2006.01)
*B26D 7/22* (2006.01)
*B65H 35/00* (2006.01)
(Continued)

(52) U.S. Cl.
CPC . *B41J 11/70* (2013.01); *B26D 7/22* (2013.01); *B41J 11/706* (2013.01); *B65H 35/0086* (2013.01); *B65H 35/06* (2013.01);
(Continued)

(58) Field of Classification Search
CPC .... B41J 11/70; B41J 11/706; B65H 35/0086; B65H 35/06; B65H 2407/10; B65H 2601/321
USPC ..... 400/621, 691, 693, 120.16; 83/859, 83/860, 694, 697, 202, 240–243, 523; 347/197
See application file for complete search history.

(56) References Cited

U.S. PATENT DOCUMENTS 1,651,415 A * 12/1927 Smith ..... 400/690.4
4,119,385 A * 10/1978 Watanabe et al. ..... 400/215.3
(Continued)

FOREIGN PATENT DOCUMENTS

EP 1923225 A1 * 5/2008 ..... B41J 11/70
EP 2 108 517 10/2009
(Continued)

OTHER PUBLICATIONS

Wikipedia. "Thermal transfer printing." <http://en.wikipedia.org/wiki/Thermal_transfer_printing>.*
(Continued)

*Primary Examiner* — Kenneth E. Peterson
*Assistant Examiner* — Jennifer Swinney
(74) *Attorney, Agent, or Firm* — Ostrolenk Faber LLP

(57) ABSTRACT

A cutting apparatus which avoids exposing a fixed blade mounted in a lid portion even when the lid portion is opened. A fixed blade 40 is arranged so that a blade surface 40*b* faces the upstream side in the direction of transport of a printed medium 1. A cover 48 is slidably mounted on the fixed blade 40, is configured to cover a cutting edge line 40*a* of the fixed blade 40 from the side of the blade surface 40*b* when a lid portion 13 is released, and may be slid toward a root of the fixed blade 40 to expose the cutting edge line 40*a* of the fixed blade 40 when the lid portion 13 is closed.

3 Claims, 6 Drawing Sheets

(51) Int. Cl.
*B65H 35/06* (2006.01)
*B26D 1/08* (2006.01)
*B26D 7/00* (2006.01)

(52) U.S. Cl.
CPC ..... *B26D 1/085* (2013.01); *B26D 7/00* (2013.01); *B65H 2407/10* (2013.01); *B65H 2601/321* (2013.01)

(56) References Cited

U.S. PATENT DOCUMENTS

| | | | | |
|---|---|---|---|---|
| 4,702,631 | A * | 10/1987 | Watanabe | 400/208 |
| 5,833,380 | A * | 11/1998 | Hosomi et al. | 400/621 |
| 6,118,469 | A * | 9/2000 | Hosomi | 347/222 |
| 8,358,324 | B2 * | 1/2013 | Kokuta | 347/197 |
| 2005/0207813 | A1 * | 9/2005 | Takabatake et al. | 400/88 |
| 2007/0028739 | A1 * | 2/2007 | Kawaguchi | 83/651 |
| 2008/0003039 | A1 * | 1/2008 | Sekino et al. | 400/188 |
| 2009/0086006 | A1 * | 4/2009 | Koyabu et al. | 347/197 |

FOREIGN PATENT DOCUMENTS

| | | | | |
|---|---|---|---|---|
| JP | 2-35698 | | 3/1990 | |
| JP | 2035698 | | 3/1990 | |
| JP | 11245476 | A * | 9/1999 | B41J 25/304 |
| JP | 2000-052291 | | 2/2000 | |
| JP | 2002-128328 | A | 5/2002 | |
| JP | 2003-305907 | | 10/2003 | |
| JP | 2008-119838 | A * | 5/2008 | B26D 1/08 |
| JP | 2008-119838 | A | 5/2008 | |

OTHER PUBLICATIONS

International Search Report dated Feb. 24, 2009, issued in corresponding international application No. PCT/JP2008/071853.
European Search Reported dated Jan. 9, 2014 issued in European Patent Application No. 08874803.3.

* cited by examiner

CUTTING APPARATUS

CROSS-REFERENCE TO RELATED APPLICATIONS

The present application is a 35 U.S.C. §§371 national phase conversion of PCT/JP2008/071853, filed Dec. 2, 2008, which claims priority of Japanese Application No. 2008-167798, filed Jun. 26, 2008, the contents of which are incorporated by reference herein. The PCT International Application was published in the Japanese language.

TECHNICAL FIELD

The present invention relates to a guillotine-type cutting apparatus including a fixed blade and a movable blade and, in particular, to a guillotine-type cutting apparatus integrated into a printer in such a manner that the movable blade is mounted in a casing body of a printer, and the fixed blade of the guillotine-type cutting apparatus is mounted in a lid portion which is movable with respect to the casing body.

BACKGROUND ART

In the related art, a printer is known having a cutting apparatus configured in such a manner that a movable blade of a guillotine-type cutting apparatus is mounted in a casing body, and a fixed blade of the guillotine-type cutting apparatus is mounted in a lid portion which is movable with respect to the casing body, and the fixed blade and the movable blade are moved significantly away from each other when the lid portion is released, so that replacement of a roll sheet (printed medium), cleaning, or the like, which is frequently performed, can smoothly be performed (for example, see JP-A-2003-305907).

However, in the related art, if the lid portion is opened for performing the replacement of the roll sheet (printed medium), for cleaning, or the like, the fixed blade mounted in the lid portion is exposed. Therefore, aforesaid operations, such as the replacement or the cleaning, are required to be performed while keeping away from the exposed fixed blade, which results in a problem of lowering of operating efficiency.

DISCLOSURE OF INVENTION

In view of such problems, it is an object of the present invention to provide a cutting apparatus which prevents exposing a fixed blade mounted in a lid portion even when the lid portion is opened for replacement of a roll sheet (printed medium), for cleaning, or the like, thereby allowing operations such as the replacement or cleaning to be performed without need for paying attention to the fixed blade mounted in the lid portion and thereby improving operating efficiency.

In order to solve the above-described problem, the present invention is configured as described below.

The gist of the invention comprises a cutting apparatus integrated into a printer having a lid portion which is capable of being opened and closed over an upper part of a casing body and which is configured to cut a printed medium having print applied thereon by moving a movable blade mounted in the casing body toward a fixed blade mounted in the lid portion and engaging the blades with each other. The fixed blade is a single-edged blade arranged so that a blade surface faces the upstream side in the direction of transport of the printed medium. A cover is slidably mounted on the fixed blade so as to cover a cutting edge line of the fixed blade from the side of the blade surface when the lid portion is released, wherein the cover is slid toward a root of the fixed blade to expose the cutting edge line of the fixed blade when the lid portion is closed.

The cutting apparatus is integrated into a printer having a lid portion which is capable of opening and closing an upper part of a casing body. A printing unit, having a thermal head and an ink ribbon transporting mechanism mounted thereto, is provided between the lid portion and the casing body and is configured to be fitted to and released from the lid portion. The printing unit is configured to cut a printed medium having print applied thereon by moving a movable blade mounted in the casing body toward a fixed blade mounted in the lid portion and by engaging the blades with each other. The fixed blade is a single-edged blade arranged so that a blade surface faces the upstream side in the direction of transport of the printed medium. The apparatus includes a fixed-blade holder having the fixed blade mounted thereon and configured to cause the fixed blade to be retracted so as not to come into contact with the printing unit when the printing unit that was fitted in the lid portion is pulled out. A cover slidably mounted on the fixed blade so as to cover a cutting edge line of the fixed blade from the side of the blade surface when the lid portion is released. An urging device mounted on the fixed-blade holder is configured to urge the cover toward the cutting edge line of the fixed blade. A projection projects in the urging direction of the urging device and it is formed on both ends of the cover at a distance wider than the width of the printed medium at positions out of the area of a transporting path of the printed medium. The cutting edge line of the fixed blade is covered with the cover by sliding the cover toward the cutting edge line by an urging force of the urging device when the lid portion is released. The cutting edge line of the fixed blade is exposed from the cover by sliding the cover toward a root of the fixed blade against the urging force of the urging device caused by an abutment between the projection formed on the cover and an abutted device provided on the casing body when the lid portion is closed.

Further, the cover is formed with a guide surface configured to guide the printed medium between the fixed blade and the movable blade when the lid portion is closed.

The fixed blade is arranged so that its blade surface faces upstream in the direction of transport of the printed medium. The cover is slidably mounted on the fixed blade and is configured to cover the cutting edge line of the fixed blade from the side of the blade surface when the lid portion is released, and to be slid toward the root of the fixed blade to expose the cutting edge line of the fixed blade when the lid portion is closed. Accordingly, the cutting edge line of the fixed blade is covered with the cover when the lid portion is released. Therefore, even when the lid portion is opened for the replacement of the roll sheet (printed medium) for cleaning, and the like, the fixed blade mounted in the lid portion is not exposed, and hence the operations such as the replacement, the cleaning can be performed without need for paying attention to the fixed blade mounted in the lid portion, which improves operating efficiency. Simultaneously, since the cutting edge line is configured to be covered with the cover from the side of the blade surface, the cover can be slid without being caught by the cutting edge line of the fixed blade, so that the cutting edge line of the fixed blade is effectively exposed from the cover for sure when the lid portion is closed.

The fixed-blade holder with the fixed blade mounted thereon is configured to retract the fixed blade to avoid the fixed blade coming into contact with the printing unit when the printing unit, which is fitted in the lid portion, is pulled out, with the cover slidably mounted on the fixed blade and configured to cover the cutting edge line of the fixed blade from the side of the blade surface. The urging device is mounted on the fixed-blade holder and is configured to urge the cover in the direction of the cutting edge line of the fixed blade. The projection projects in the urging direction of the urging device, which device is formed at the both ends of the cover at a distance wider than the width of the printed medium at the positions out of the area of the transporting path of the printed medium. When the lid portion is released, the cover is slid by the urging force of the urging device in the direction of the cutting edge line, and hence the cutting edge line of the fixed blade is covered with the cover. When the lid portion is closed, the projection formed on the cover abuts the abutted means formed on the casing body. Hence, the cover is slid toward the root of the fixed blade against the urging force of the urging device so that the cutting edge line of the fixed blade is exposed from the cover. In this configuration, the cover configured to cover the cutting edge line of the fixed blade is mounted to the fixed blade, and the cover is slid toward the cutting edge line by the urging device mounted on the fixed-blade holder, whereby the cutting edge line of the fixed blade is covered with the cover. Therefore, even when the fixed-blade holder causes the fixed blade to be retracted to prevent the fixed blade from coming into contact with the printing unit, the cutting edge line of the fixed blade is effectively covered with the cover for sure.

A guide surface formed on the cover is configured to guide the printed medium between the fixed blade and the movable blade when the lid portion is closed. In this configuration, the cover which covers the fixed blade when the lid portion is released, can be used as a guide configured to guide the printed medium when the lid portion is closed, simplifying the configuration of the apparatus and reducing its cost.

PREFERRED EMBODIMENT AND BEST MODES FOR CARRYING OUT THE INVENTION

Figure 1:
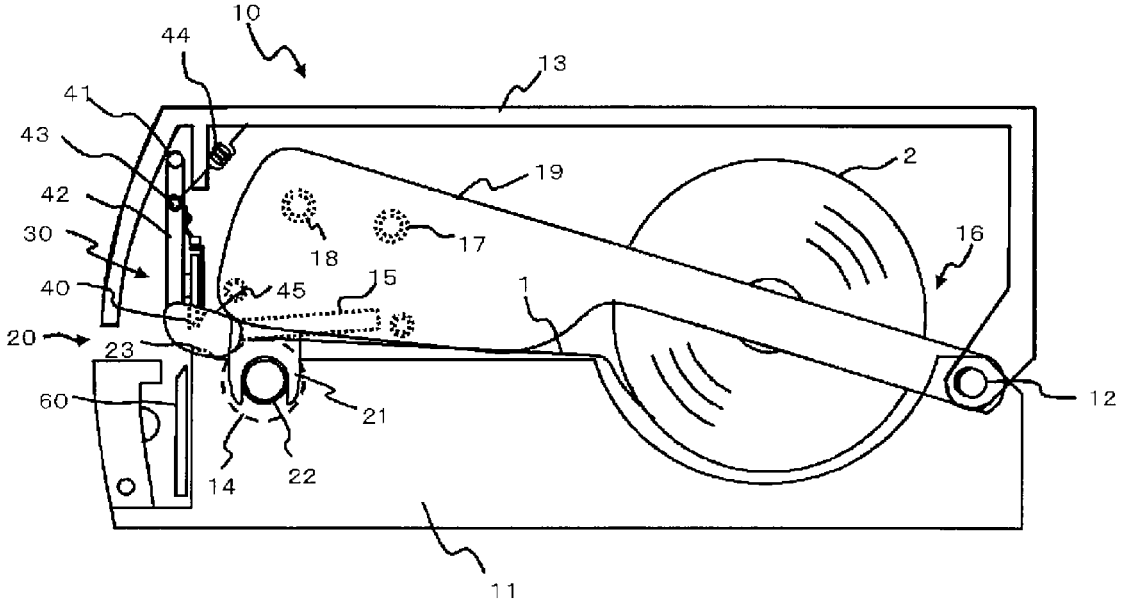
FIG. 1 is a schematic side cross-sectional view showing a configuration of a printer in which an embodiment of a cutting apparatus according to the present invention is integrated.

Referring now to the drawings, an embodiment of the present invention will be described.

Figure 2:
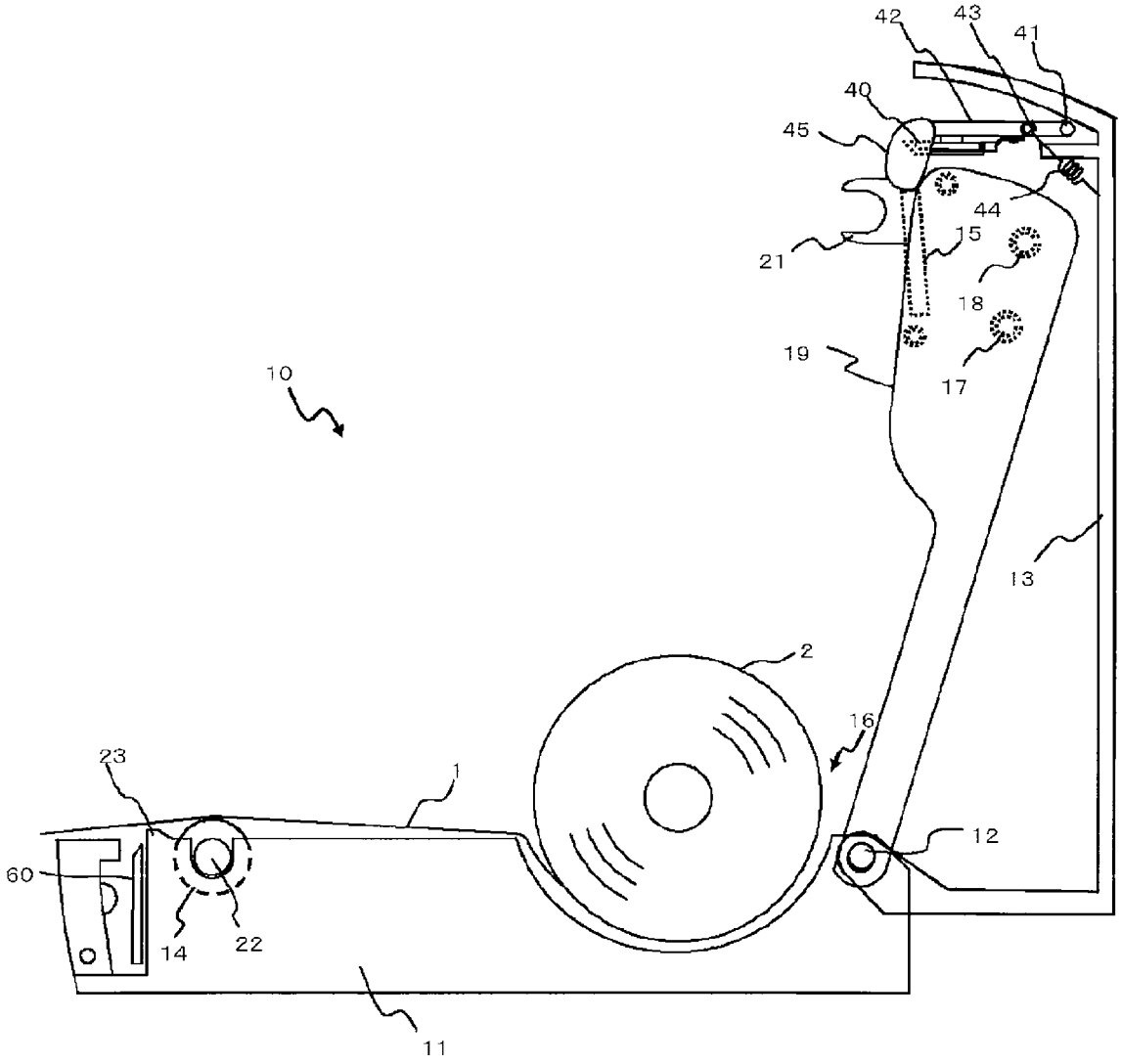
FIG. 2 is a schematic side cross-sectional view showing a lid portion of the printer in FIG. 1 opened.
Figure 3:
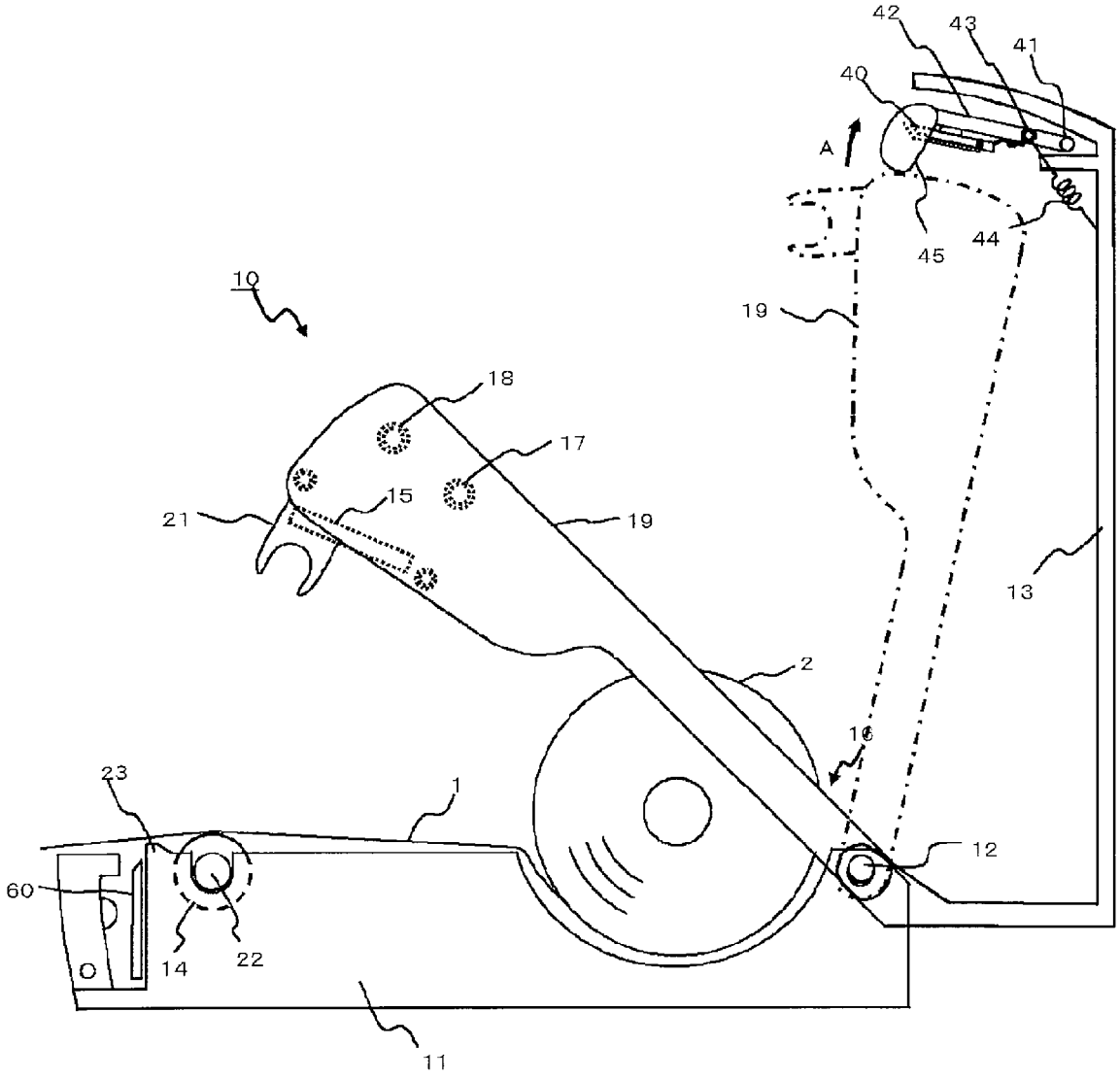
FIG. 3 is a schematic side cross-sectional view showing a printing unit of the printer pulled out.

A cutting apparatus 30 according to an embodiment is configured to cut a printed medium 1 which had been printed by a printer 10. The cutting is caused by an engagement between a fixed blade 40 and a movable blade 60 which is movable toward the fixed blade 40. Referring to FIG. 1 to FIG. 3, the cutting apparatus 30 is integrated into a lid portion 13. The lid portion 13 is supported by a supporting shaft 12 of a casing body 11. The lid is capable of opening and closing an upper part of the casing body 11. The fixed blade 40 is mounted in the lid portion 13 and the movable blade 60 is mounted in the casing body 11.

Referring to FIG. 1, the printer 10 includes a platen roller 14 and a thermal head 15 opposing the roller 14 in such a manner that a surface (hereinafter referred to as a "printing surface") having a plurality of heat-generating members formed in the widthwise direction opposes the platen roller 14 as a printing portion. These are configured to print by transporting the printed medium 1, such as a continuous label strip having a plurality of labels temporarily adhered to a belt-shaped backing strip, and an ink ribbon overlapping the labels through a strip between the platen roller 14 and the thermal head 15. Selective heating of the heat-generating members on the thermal head 15 transfers ink from the ink ribbon to the printed medium 1 in a programmed pattern of printing.

The cutting apparatus according to the embodiment having the fixed blade 40 and the movable blade 60 is assembled on the downstream side of the printing portion having the platen roller 14 and the thermal head 15 in the direction of transport of the printed medium 1. The previously printed medium 1 is cut by engagement between the fixed blade 40 and the movable blade 60 and the cut labels are is output therefrom.

The printed medium 1 is rotatably supported (stored) in a supply 16 rolled on a cylindrical member such as a paper tube, that is, as a rolled sheet 2. The medium is supplied from the supply portion 16 into the space between the platen roller 14 and the thermal head 15. The ink ribbon is wound around a ribbon supply shaft 17 and a ribbon winding shaft 18 rotated synchronously with the platen roller 14 so as to extend between them, and the ink ribbon is configured in such a manner that the ink ribbon supported by the ribbon supply shaft 17 in a state of being wound in a rolled state is supplied together with the printed medium 1 between the platen roller 14 and the thermal head 15. After the ink transfer, the ribbon is wound on the ribbon winding shaft 18.

The printer 10 includes the casing body 11 having the platen roller 14 and the supply portion 16. Releasably located on the upper part of the casing body, the lid portion 13 is configured to cover the upper part of the casing body 11.

A printing unit 19 having the thermal head 15, the ribbon supply shaft 17, and the ribbon winding shaft 18 is arranged between the casing body 11 and the lid portion 13. The lid portion 13 and the printing unit 19 are configured to be opened from the operator's side, at which there is a discharge port 20 from which the printed medium 1 is discharged after printing. The lid portion and the printing unit are rotatably supported by the supporting shaft 12 provided on the inner side of the casing body 11.

FIG. 1 shows the printer 10 in the closed state, in which the lid portion 13 is closed. In the closed state, a U-shaped engaging portion 21 provided on the printing unit 19 engages a bearing 22 of the platen roller 14 provided in the casing body 11, so that the thermal head 15 of the printing unit 19 is positioned by being pressed against the platen roller 14, and the fixed blade 40 is positioned at an adequate position with respect to the movable blade 60 provided in the casing body 11. The printing unit 19 is configured to be fitted to and released from the lid portion 13. In the closed state shown in FIG. 1, the printing unit 19 is in the fitted state, which is a state of being fitted to the lid portion 13.

FIG. 2 shows the printer 10 in an opened state, in which the lid portion 13 is opened. Since the lid portion 13 is connected to the printing unit 19 by a connecting member, not shown, the lid portion 13 and the printing unit 19 can be rotated integrally in the fitted state in which the printing unit 19 is fitted into the lid portion 13 about the supporting shaft 12 of the casing body 11 as an axis. Accordingly, the platen roller 14 in the casing body 11 and the thermal head 15 on the printing unit 19 are moved away from each other, and the upper part of the supply portion 16 provided in the casing body 11 is released and accessible to allow easy replacement of the roll sheet 2. In addition, the fixed blade 40 mounted in the lid portion 13 is moved away from the movable blade 60 mounted in the casing body 11.

FIG. 3 shows the printer 10 in a state in which the printing unit 19 is pulled out from the lid portion 13. In the opened state shown in FIG. 3, releasing the connection between the lid portion 13 and the printing unit 19 by the connecting member, not shown, allows the printing unit 19 fitted in the lid portion 13 to be pulled out toward the casing body 11 to release the upper part of the printing unit 19, and also allows the ink ribbon to be replaced. The fixed blade 40 is attached to a fixed-blade holder 42 configured to be rotatable in the lid portion 13 around a holder shaft 41 supported in the lid portion 13. The fixed-blade holder 42 is constantly urged toward the printing unit 19 by tension springs 44 interposed between projection 43 formed on the fixed-blade holder 42 and the lid portion 13.

Figure 4:
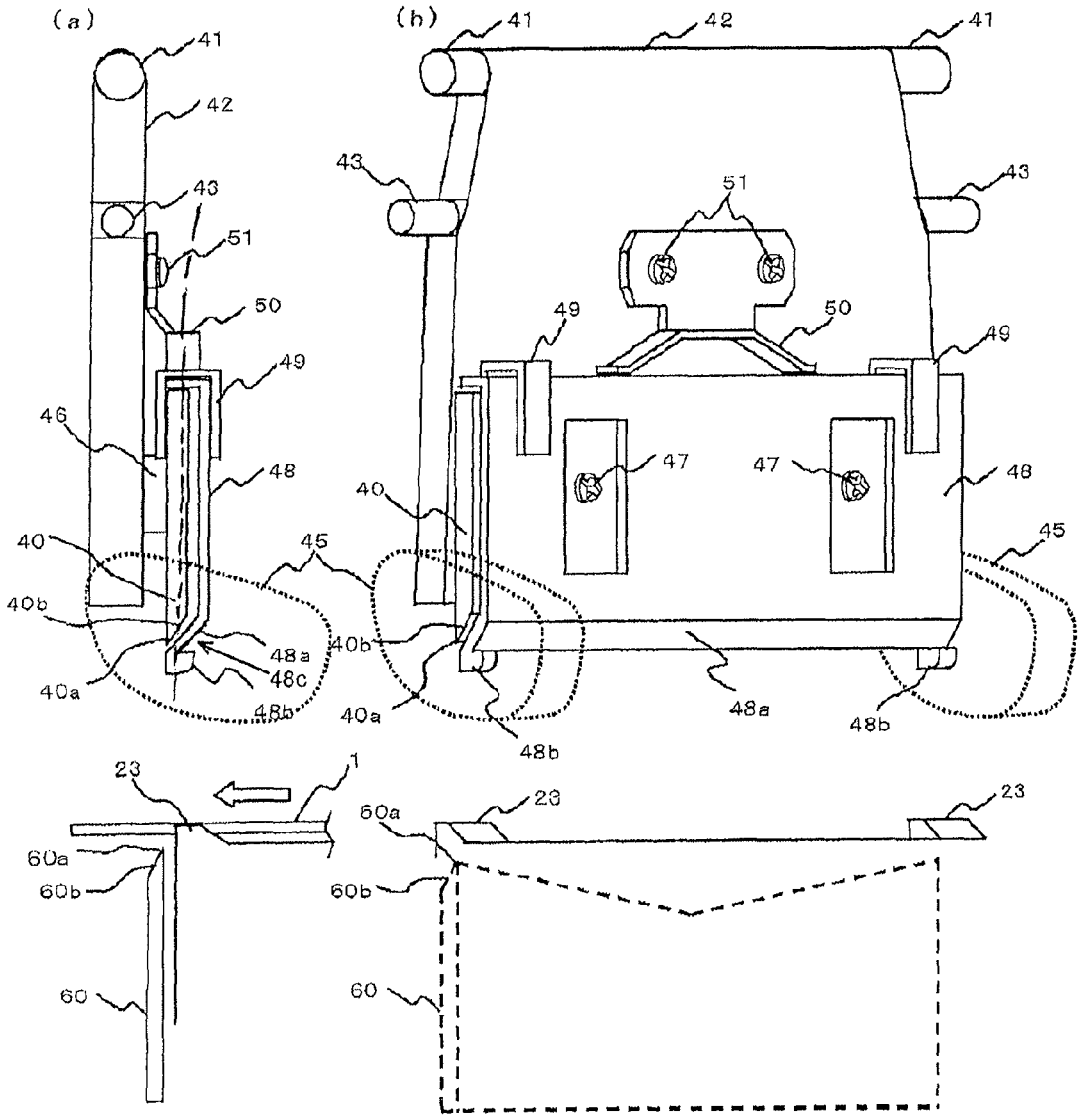
FIG. 4*a* shows a side view and FIG. 4*b* a perspective view showing a configuration of the cutting apparatus according to the present invention in a fixed-blade-hidden state in the embodiment.
Figure 5:
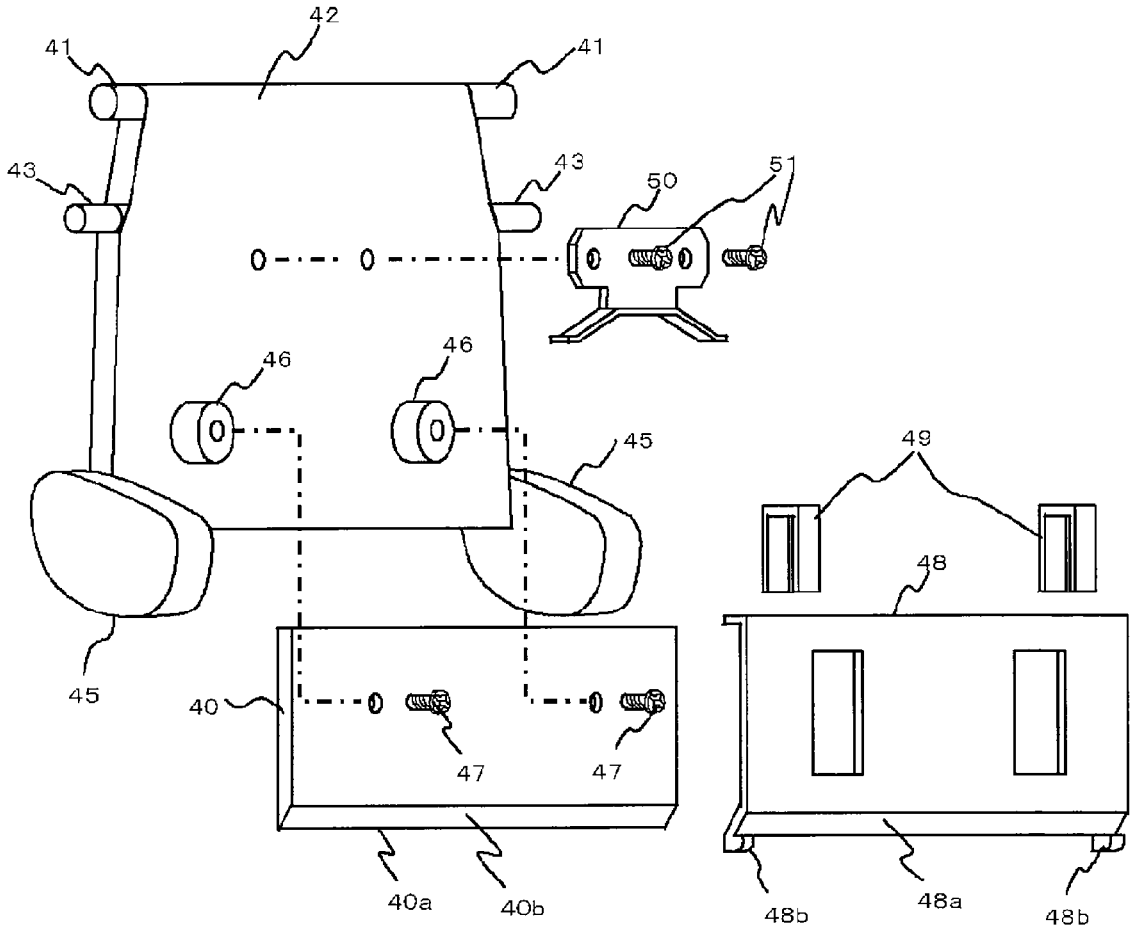
FIG. 5 is an exploded perspective view showing a configuration of a mounting unit for the fixed blade and the cover shown in FIG. 4.

Referring to FIGS. 4 and 5, the fixed-blade holder 42 is provided with sliding strips 45 which are in sliding contact with the printing unit 19 on both sides thereof at a distance wider than the width of the printed medium 1 at positions out of the area of a transporting path of the printed medium 1, respectively. Accordingly, the fitted state, in which the printing unit 19 is fitted into the lid portion 13, is maintained by the sliding strips 45 of the fixed-blade holder 42 being pressed against the printing unit 19 by the urging force of the tension springs 44. In contrast, when pulling out the printing unit 19 from the lid portion 13, the fixed-blade holder 42 is rotated in the direction indicated by an arrow A in FIG. 3, that is, in the direction in which the fixed blade 40 moves away from the printing unit 19, against the urging forces applied by the tension springs 44 by the sliding contact of the sliding strips 45 with the printing unit 19, so that the fixed blade 40 is retracted so as not to contact with the printing unit 19.

Referring to FIG. 4 and FIG. 5, the fixed blade 40 includes a linear cutting edge line 40*a*. The blade 40 is fixed to mount portions 46 formed on the fixed-blade holder 42 with screws 47. In the closed state shown in FIG. 1, the blade is arranged so that the linear cutting edge line 40*a* opposes the movable blade 60 provided on the casing body 11, that is, opposes a cutting edge line 60*a* having a V-shaped depression at a center in the direction of cutting width of the movable blade 60. The fixed blade 40 and the movable blade 60 are each a single-edged blade and, in the closed state shown in FIG. 1, are arranged so that a blade surface 40*b* of the fixed blade 40 faces the upstream side in the direction of transport of the printed medium 1, and a blade surface 60*b* of the movable blade 60 faces the downstream side in the direction of transport of the printed medium 1, respectively. These are configured in such a manner that the cutting edge line 40*a* of the fixed blade 40 and the cutting edge line 60*a* of the movable blade 60 engage by moving the movable blade 60 toward the fixed blade 40.

A cover 48 covers the cutting edge line 40*a* on the side of the blade surface 40*b* mounted to the fixed blade 40 and is fixed to the fixed-blade holder 42 by angular U-shaped clips 49 so that the cover 48 is slidable along the fixed blade 40. A spring 50 urges the cover 48 toward the cutting edge line 40*a* of the fixed blade 40 is fixed to the fixed-blade holder 42 by screws 51. In a state in which the cover is not being applied with an external force but is being urged by the spring 50, that is, when the lid portion 13 is opened as shown in FIG. 2 and FIG. 3, the cover 48 is slid toward the cutting edge line 40*a* by the urging force of the spring 50 as shown in FIG. 4. Hence, the cover extends from the blade surface 40*b* side to the cutting edge line 40*a* to cover the cutting edge line 40*a*, whereby a fixed-blade-hidden state is assumed, in which the cutting edge line 40*a* is covered with the cover 48 so as not to be exposed.

The cover 48 is formed of an elastic material such as resin. It is formed with a guide surface 48*a* on a surface opposite from a surface opposing the blade surface 40*b* of the fixed blade 40. It is formed with projecting portions 48*b* which project in the urging direction of the spring 50 at both ends thereof at a distance wider than the width of the printed medium 1 and at positions out of the area of the transport path of the printed medium 1, respectively.

Figure 6:
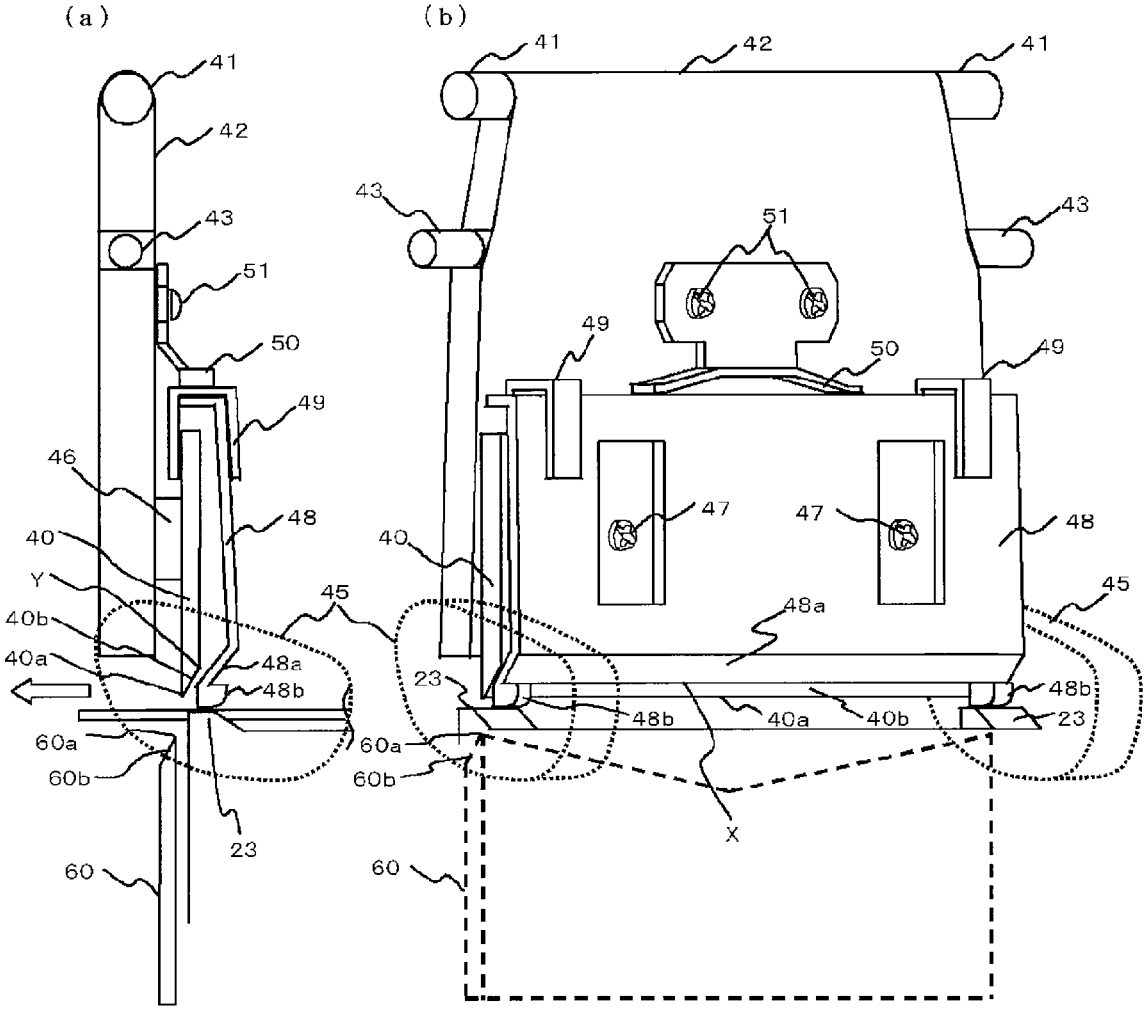
FIG. 6*a* shows a side view and FIG. 6*b* a perspective view showing a configuration of the cutting apparatus according to the present invention in a fixed-blade-exposed state in the embodiment.

In the closed state shown in FIG. 1, in which the lid portion 13 is closed, the projecting portions 48*b* formed on the cover 48 abut abutted portions 23 on the casing body 11, as shown in FIG. 4. The cover 48 is slid toward the root of the fixed blade 40 upward against the urging force applied by the spring 50, producing a fixed-blade-exposed state in which the cutting edge line 40*a* is exposed from the cover 48, as shown in FIG. 6. In this embodiment, since the cutting edge line 40*a* is covered by the cover 48 from the side of the blade surface 40*b*, the cover 48 is moved along the blade surface 40*b* when the projecting portions 48*b* come into abutment with the abutted portions 23 of the casing body 11 and the cover 48 is slid toward the root of the fixed blade 40. Therefore, the cover 48 can expose the cutting edge line 40*a* of the fixed blade 40 without the cover being caught by the cutting edge line 40*a* of the fixed blade 40.

Also, in the fixed-blade-exposed state shown in FIG. 6, the guide surface 48*a* formed on the cover 48 forms an acute angle with respect to the direction of transport of the printed medium 1 indicated by an arrow in FIG. 6(*a*), and the height of the lowermost side X of the guide surface 48*a* is positioned at a level lower than the height of the uppermost side Y of the blade surface 40*b*. Therefore, the printed medium 1 being nipped and transported, and then printed by the printing portion is guided by the guide surface 48*a* and the blade surface 40*b* even when the leading edge comes into abutment with the guide surface 48*a* due to a runout, and is guided between the fixed blade 40 and the movable blade 60. Therefore, the guide surface 48*a* of the cover 48 guides the printed medium 1 printed by the printing portion between the fixed blade 40 and the movable blade 60.

The fixed blade 40 is arranged so that the blade surface 40*b* faces in the upstream the direction of transport of the printed medium 1. The cover 48 is slidably mounted on the fixed blade 40 and includes first portion 48*c* that lies on a longitudinal axis of fixed blade 40 when the lid is open. The cover 48 is configured to cover the cutting edge line 40*a* of the fixed blade 40 from the side of the blade surface 40*b* when the lid portion 13 is released, and to be slid toward the root of the fixed blade 40 to expose the cutting edge line 40*a* of the fixed blade 40 when the lid portion 13 is closed. Accordingly, the cutting edge line 40*a* of the fixed blade 40 is covered by the cover 48 when the lid portion 13 is released. Therefore, even when the lid portion 13 is opened for the replacement of the roll sheet 2 (printed medium 1) or the cleaning, the fixed blade 40 mounted in the lid portion 13 is not exposed, and hence the operations such as the replacement and the cleaning can be performed without attention to the fixed blade 40 mounted in the lid portion, improving the operating efficiency. Simultaneously, since the cutting edge line 40*a* is configured to be covered with the cover 48 from the side of the blade surface 40*b*, the cover 48 can be slid without being caught by the cutting edge line 40*a* of the fixed blade 40, so that the cutting edge line 40*a* of the fixed blade 40 is effectively exposed from the cover 48 for sure when the lid portion 13 is closed.

The fixed-blade holder 42 with the fixed blade 40 mounted thereon is configured to retract the fixed blade 40 to avoid the fixed blade 40 coming into contact with the printing unit 19 when the printing unit 19 that had been fitted in the lid portion 13 is pulled out, while the cover 48 slidably mounted on the fixed blade 40 is configured to cover the cutting edge line 40*a* of the fixed blade 40 from the side of the blade surface 40*b*. The spring 50 is mounted on the fixed-blade holder 42 and configured to urge the cover 48 in the direction of the cutting edge line 40*a* of the fixed blade 40. The portions 48*b* project in the urging direction of the spring 50, which are formed at the both ends of the cover 48 at a distance wider than the width of the printed medium 1 at the positions out of the area of the transporting path of the printed medium 1. When the lid portion 13 is released, the cover 48 is slid by the urging force of the spring 50 in the direction of the cutting edge line 40*a*, whereby the cutting edge line 40*a* of the fixed blade 40 is covered by the cover 48. When the lid portion 13 is closed, the spring 50 formed on the cover 48 abuts the abutted portions 23 formed on the casing body 11, causing the cover 48 to slide toward the root of the fixed blade 40 against the urging force of the spring 50 so that the cutting edge line 40*a* of the fixed blade 40 is exposed from the cover 48. In this configuration, the cover 48 which is configured to cover the cutting edge line 40*a* of the fixed blade 40 is mounted to the fixed blade 40, and the cover 48 is slid toward the cutting edge line 40*a* by the spring 50 mounted on the fixed-blade holder 42, whereby the cutting edge line 40*a* of the fixed blade 40 is covered by the cover 48. Therefore, even when the fixed-blade holder 42 causes the fixed blade 40 to be retracted to prevent the fixed blade 40 from coming into contact with the printing unit 19, the cutting edge line 40*a* of the fixed blade 40 is effectively covered by the cover 48.

The guide surface 48*a* which is configured to guide the printed medium 1 between the fixed blade 40 and the movable blade 60 when the lid portion 13 is closed is formed on the cover 48. In this configuration, the cover 48 which covers the fixed blade 40 when the lid portion 13 is released can be used to guide the printed medium 1 when the lid portion is closed, so that the configuration of the apparatus can be simplified and cost reduction is effectively achieved.

It is apparent that the present invention is not limited to the respective embodiments described above, and the respective embodiments may be modified as needed within the scope of the technical idea of the present invention. Also, the numbers, the positions, and the shapes of the respective components are not limited to those in the above described embodiment, and the numbers, the positions, and the shapes suitable for implementing the present invention may be employed. In the respective drawings, the same components are designated by the same reference numerals.

The invention claimed is:

1. A cutting apparatus integrated into a printer having a lid portion configured to open and to close an upper part of a casing body and a printing unit having a thermal head and an ink ribbon transporting mechanism mounted thereto, provided between the lid portion and the casing body, and configured to be fitted to and released from the lid portion and configured to cut a printed medium having print applied thereon by moving a movable blade mounted in the casing body toward a fixed blade mounted in the lid portion and engaging the same with each other, the fixed blade comprising a root at a first end, a blade surface, and a second end remote from the first end, the second end having a cutting edge line positioned to engage the movable blade when the movable blade is moved toward the fixed blade, the fixed blade arranged so that the blade surface faces an upstream side in a direction of transport of the printed medium, the cutting apparatus comprising:

a fixed-blade holder having the fixed blade mounted thereon and configured to cause the fixed blade to be retracted so as to avoid contact with the printing unit when the printing unit fitted in the lid portion is pulled out;

a cover slidably mounted on the fixed blade, the cover having a first portion, and, the first end of the fixed blade, the second end of the fixed blade, and the first portion of the cover lying on a first axis such that the second end is located at a point on the first axis between the first end and the first portion of the cover, an entirety of the first portion positioned transverse to the first axis, when the lid portion is released;

an urging device mounted on the fixed-blade holder and configured to urge the cover to slide in a direction parallel to the first axis, such that the cover is moved toward the cutting edge line of the fixed blade; and a projection projecting in the urging direction of the urging device and formed on both ends of the cover spaced at a distance wider than the width of the printed medium and at positions out of an area of a transporting path of the printed medium, wherein the cover is configured for a sliding movement of the cover by an urging force supplied by the urging device when the lid portion is released so that the second end of the fixed blade, including the cutting edge line of the fixed blade and a side of the second end adjacent the blade surface, is covered with the cover, and such that the cutting edge line of the fixed blade is exposed from the cover by a sliding movement of the cover against the urging force of the urging device and caused by abutment between the projection on the cover with an abutted area provided on the casing body when the lid portion is closed.

2. A cutting apparatus integrated into a printer having a lid portion configured to open and to close an upper part of a casing body and a printing unit having a thermal head and an ink ribbon transporting mechanism mounted thereto, provided between the lid portion and the casing body, and configured to be fitted to and released from the lid portion and configured to cut a printed medium having print applied thereon by moving a movable blade mounted in the casing body toward a fixed blade mounted in the lid portion and engaging the same with each other, the fixed blade comprising a root at a first end, a blade surface, and a second end remote from the first end, the second end having a cutting edge line positioned to engage the movable blade when the movable blade is moved toward the fixed blade, the fixed blade arranged so that the blade surface faces an upstream side in a direction of transport of the printed medium, the cutting apparatus comprising:

a fixed-blade holder having the fixed blade mounted thereon and configured to cause the fixed blade to be retracted so as to avoid contact with the printing unit when the printing unit fitted in the lid portion is pulled out;

a cover slidably mounted on the fixed blade, the cover having a first portion, and, the first end of the fixed blade, the second end of the fixed blade, and the first portion of the cover lying on a first axis such that the second end is located at a point on the first axis between the first end and the first portion of the cover, an entirety of the first portion positioned transverse to the first axis, when the lid portion is released;

an urging device mounted on the fixed-blade holder and configured to urge the cover to slide in a direction parallel to the first axis, such that the cover is moved toward the cutting edge line of the fixed blade; and a projection projecting in the urging direction of the urging device and formed on both ends of the cover spaced at a distance wider than the width of the printed medium and at positions out of an area of a transporting path of the printed medium, wherein the cover is configured for a sliding movement of the cover by an urging force supplied by the urging device when the lid portion is released so that the second end of the fixed blade, including the cutting edge line of the fixed blade and a side of the second end adjacent the blade surface, is covered with the cover, and such that the cutting edge line of the fixed blade is exposed from the cover by a sliding movement of the cover against the urging force of the urging device and caused by abutment between the projection on the cover with an abutted area provided on the casing body when the lid portion is closed, wherein the cover includes a guide surface configured to guide the printed medium between the fixed blade and the movable blade when the lid portion is closed.

3. A cutting apparatus integrated into a printer having a lid portion configured to open and to close an upper part of a casing body and a printing unit having a thermal head and an ink ribbon transporting mechanism mounted thereto, provided between the lid portion and the casing body, and configured to be fitted to and released from the lid portion and configured to cut a printed medium having print applied thereon by moving a movable blade mounted in the casing body toward a fixed blade mounted in the lid portion and engaging the same with each other, the fixed blade comprising a root at a first end, a blade surface, and a second end remote from the first end, the second end having a cutting edge line positioned to engage the movable blade when the movable blade is moved toward the fixed blade, the fixed blade arranged so that the blade surface faces an upstream side in a direction of transport of the printed medium, the cutting apparatus comprising:

a fixed-blade holder having the fixed blade mounted thereon and configured to cause the fixed blade to be retracted so as to avoid contact with the printing unit when the printing unit fitted in the lid portion is pulled out;

a cover slidably mounted on the fixed blade, the cover having a first portion, and, the first end of the fixed blade, the second end of the fixed blade, and the first portion of the cover lying on a first axis such that the second end is located at a point on the first axis between the first end and the first portion of the cover, an entirety of the first portion positioned transverse to the first axis, when the lid portion is released;

an urging device mounted on the fixed-blade holder and configured to urge the cover to slide in a direction parallel to the first axis, such that the cover is moved toward the cutting edge line of the fixed blade; and a projection projecting in the urging direction of the urging device and formed on both ends of the cover spaced at a distance wider than the width of the printed medium and at positions out of an area of a transporting path of the printed medium, wherein the cover is configured for a sliding movement of the cover by an urging force supplied by the urging device when the lid portion is released so that the second end of the fixed blade, including the cutting edge line of the fixed blade and a side of the second end adjacent the blade surface, is covered with the cover, and such that the cutting edge line of the fixed blade is exposed from the cover by a sliding movement of the cover against the urging force of the urging device and caused by abutment between the projection on the cover with an abutted area provided on the casing body when the lid portion is closed, wherein the cover includes a guide surface configured to guide the printed medium between the fixed blade and the movable blade when the lid portion is closed, wherein the blade surface has an uppermost end at the cutting edge, and the guide surface formed on the cover forms an acute angle with respect to the direction of transport of the printed medium, and a height of the lowermost side of the guide surface is positioned at a level lower than a height of the uppermost end of the blade surface.

* * * * *